US005495736A

United States Patent [19]

Nishi et al.

[11] Patent Number: 5,495,736

[45] Date of Patent: Mar. 5, 1996

[54] METHOD AND APPARATUS FOR DESCALING AND COLD ROLLING METAL STRIP

[75] Inventors: Hidetoshi Nishi; Hideo Kobayashi, both of Hitachi, Japan

[73] Assignee: Hitachi, Ltd., Tokyo, Japan

[21] Appl. No.: 85,299

[22] Filed: Jul. 2, 1993

[30] Foreign Application Priority Data

Jul. 2, 1992 [JP] Japan ..... 4-175482

[51] Int. Cl.[6] ..... B21B 1/36; B65H 18/08

[52] U.S. Cl. ..... 72/39; 72/229; 72/365.2; 242/530

[58] Field of Search ..... 72/39, 40, 228, 72/229, 234, 365.2, 366.2; 242/78.1, 78.6

[56] References Cited

U.S. PATENT DOCUMENTS

| | | | |
|---|---|---|---|
| 2,025,002 | 12/1935 | McIlvried | 72/229 |
| 3,060,945 | 10/1962 | Spenle | 72/39 |
| 3,918,282 | 11/1975 | Eire | 72/228 |
| 4,123,011 | 10/1978 | Kajiwara | 242/78.1 |
| 4,188,812 | 2/1980 | Nomura et al. | 72/203 |

FOREIGN PATENT DOCUMENTS

| | | | |
|---|---|---|---|
| 0145205 | 7/1985 | Japan | 242/78.1 |
| 463939 | 4/1937 | United Kingdom . | |

OTHER PUBLICATIONS

Patent Abstracts of Japan, vol. 3, No. 27 (C–39) Mar. 7, 1979; JPA–54 004 851 Jan. 1979.

Patent Abstracts of Japan, vol. 3, No. 83 (C–52) Jul. 18, 1979; JPA–54 058 664 May 1979.

Patent Abstracts of Japan, vol. 6, No. 142 (M–146) Jul. 31, 1982; JPA–57 064 403 Apr. 1982.

Patent Abstracts of Japan, vol. 10, No. 211 (M–501) Jul. 24, 1986; JPA–61 052 901 Mar. 1986.

*Primary Examiner*—Lowell A. Larson
*Assistant Examiner*—Thomas C. Schoeffler
*Attorney, Agent, or Firm*—Evenson McKeown Edwards & Lenahan

[57] ABSTRACT

In descaling and cold rolling of metal strip, there are performed the steps of joining strips longitudinally together, passing the joined strip continuously through a descaler, subdividing the descaled strip into long strip lengths and coiling the long strip lengths into large coils at a first coiling station having a plurality of coiling drums, feeding the large coils from said coiling station to a cold rolling mill and rolling each of them in the mill. The cold rolling mill is a reversing multi-pass cold rolling mill in which the strip is rolled in a plurality of passes with reversal. To achieve efficient use of the capacity of the reversing mill while reducing the size of the descaler, coiling and uncoiling of two said large coils respectively take place simultaneously at the first coiling station, and each long strip length is coiled a first time on one of the coiling drums at the coiling station on exit from said descaler and at least a second time on the same coiling drum during its rolling in the mill. Apparatus for carrying out such a method is also described.

29 Claims, 2 Drawing Sheets

METHOD AND APPARATUS FOR DESCALING AND COLD ROLLING METAL STRIP

BACKGROUND OF THE INVENTION

1. Field of the Invention

This invention relates to a method and apparatus for the descaling and subsequent cold-rolling of metal strip, particularly but not exclusively steel sheet in the form of strip.

2. Description of the Prior Art

In the making of steel strip, there is a descaling step for removing rust (or scale) from the surface of a hot coil and a cold rolling step for reducing the strip to a predetermined thickness. The descaling step has had its efficiency improved by combining a chemical method (e.g. pickling) and a mechanical method. On the other hand, the cold rolling step is exemplified by either a reversing mill for rolling multiple passes reversibly, or by a tandem mill system for rolling in one pass in one direction through a plurality of rolling machines.

Many existing general plants perform the descaling step and the cold rolling step discontinuously. Since the descaling step employs a continuous line passing hot coils sequentially, an expensive welder is arranged at the entrance side of the descaler. In order to prevent interruption of the line during the welding, moreover, a long accumulator (looper) and a long pickling tank are provided. Since, moreover, the pickled coil has to be fed to the cold rolling mill line, the pickled coil is divided again at the exit of the pickling equipment so that it may be sized suitably for the transfer and storage in the factory, until it is taken up for cold rolling. Between the pickling equipment and the cold rolling mill line, there may be a wide coil yard for absorbing the difference between the production schemes of the two equipments. This yard is equipped with facilities for transferring, storing and managing the coils.

An alternative approach has already been practiced using continuous pickling and cold rolling equipment, in which the pickling equipment and the tandem mill are directly connected.

With the aim of obtaining benefit from use of a single multi-pass reversing roll mill, it has been proposed to employ large size coils, composed of a strip having a length several times, e.g. five times, that of the normal transportable coil. JP-B-57-39844 shows a welder for joining short coils, after which the strip is wound into a large size coil. The welding line stops when the large size coil is completed, and this coil is then unwound through a Sendzimir mill. Multi-pass rolling through this mill takes place, rewinding at each end being onto further drums. The final rolling pass leads to rewinding into the small coils, with shears subdividing the strip. The function of the large coil is to achieve a high yield and high production capacity of the reversing mill, by minimizing the periods of acceleration and deceleration of the mill and of threading the strip. Yield is also increased. However, this document does not concern itself with the combination of a descaler and a mill.

Another use of such large size coils, for a different purpose, is shown by JP-B-59-52710. This discloses a line having a welder, an accumulator, a descaler, shears and large size coils on a pair of interchangeable drums. A single pass tandem mill is fed from the large coils alternatingly and delivers rolled strip to shears and drums for small coils. The size of the large coil is said to be five to ten times the standard small size. The reason given for the use of the large coil is to allow continued operation of the descaler even when the mill is stopped. There may be many reasons for stoppage of the mill such as roll changing. Thus, the formation of the larvae coils is apparently necessary only in order to deal with such a stoppage of the mill. Since there are no particular restrictions on the capacity of the descaler, the objective in this apparatus must be to maximize the capacity of the expensive tandem rolling mill. This means that the capacity of the descaler must be equal to the desired capacity of the rolling mill, and consequently the throughput speed of the descaler must be at least equal to that of the rolling mill. A large and expensive descaler is required. The capacity of a tandem mill is in principle much greater than that of a reversing mill.

A clear distinction in the prior art exists between the concept of using a tandem mill, where the aim is to achieve maximum use of the very high capacity of the expensive tandem mill, and on the other hand the concept of use of a reversing multi-pass cold rolling mill, whose capacity is much less than that of the tandem mill. The aim of this second concept is to arrange the plant to achieve, in an economical way, a maximum throughput through the reversing mill, together with if possible, high quality of product.

FIGS. 3 and 4 illustrate this distinction by presenting data of the descaling equipment (i.e. the pickling equipment) and the cold rolling equipment prevailing at present in Japan.

FIG. 3 plots the correlation between the nominal production capacity (per month) of the pickling equipment and the line length of each line. These correlations naturally disperse depending upon the layout of the individual equipments and the product mixing ratios. However, as a whole it can be seen that:

(1) a large line length is required for a high production capacity; and (2) the line will not always become short in proportion to the capacity in an equipment having a low production capacity.

On the other hand, FIG. 4 presents the distribution of the nominal production capacity (per month) and the number of such cold rolling plants existing in Japan. For example, numeral 1 indicates a so-called "single-stand reversing mill", and numeral 5 indicates a so-called "five-stand tandem mill". For cold rolling plants, as a whole it can concluded that:

(1) a higher production capacity can be achieved by a larger number of stands of the rolling mill; and (2) a small production capacity can be realized by a single stand mill.

Thus, the situation for a descaling and cold rolling apparatus at present is as follows:

(1) a production capacity higher than 100,000 tons per month can be achieved by a large-scale pickling equipment having a line length of 200 to 300 m and a large-scale tandem mill having 5 to 6 stands; and (2) a production capacity lower than 30,000 tons per month can be achieved by a pickling equipment having a line of length 100 m, which is rather long in relation to the production capacity and a single stand reversing mill of the smallest scale.

However, for a line having a medium production capacity of about 50,000 tons per month between the foregoing capacities (1) and (2):

(3) the pickling equipment requires a scale as large as that of 100,000 tons per month; and (4) the cold rolling equipment has to adopt a multi-stand tandem mill having a scale as large as 100,000 tons per month because it is required to effect a predetermined thickness reduction in one pass, or a plurality of single stand reversing mills having a low production capacity have to be provided.

Thus, the equipment is so redundant relative to the desired production capacity that high and uneconomical investment is required.

On the other hand, the needs for the production and supply of steel sheet materials are not domestic but worldwide, and instead of the large-scale mills which have existed, medium-scale steel sheet production facilities are desired near the markets for the product.

In order to satisfy the above-specified needs, facilities are required for realizing a highly economical descaling and cold rolling method which is compact for the production scale but requires no excessive investment, and apparatus for realizing that method. However, these are hard to realize with the methods of the prior art.

With the existing plants of the prior art, the following problems are present.

(1) The continuous pickling line connects hot coils consecutively, so that an expensive welder is arranged at the entrance of the pickling equipment. In order to avoid interruption of the line during the welding, a long accumulator is arranged together with a long pickling tank, so that the line length is seriously enlarged as a whole.

(2) The pickled coils to be fed to the cold rolling equipment at a subsequent step are made by dividing the strip again so that their size may be suited for transfer and storage in the factory.

(3) It is also necessary to interpose between the pickling equipment and the cold rolling equipment a wide coil yard for absorbing the difference between the production schemes of the two equipments and plant facilities for transferring, storing and managing the coil in that region.

On the other hand, the above-specified items (2) and (3) are rationalized in the continuous pickling and cold rolling apparatus proposed in the prior art in which the pickling equipment and the tandem mill are directly connected. However, this apparatus naturally requires large-scale devices such as a large accumulator between the pickling equipment and the tandem mill so that it is effective for the very high production capacity of the tandem mill, but is of excessive size and cost for a plant having a medium production capacity.

Next, as to the cold rolling equipment, the tandem mills described above are suited for the large-scale plant having a large production capacity but not for a plant having a medium production ability.

On the other hand, the reversing mill has a scale suitable for the case in which a small production capacity is to be attained, but it has been thought that the number of such mills has to be increased for a medium-scale production capacity. A proposal is made in JP-A-57-64403 to combine a descaler and a reversing mill in a continuous line, but this results in a large, expensive and impractical plant, whose capacity is actually limited. JP-A-57-64403 describes a plant for continuous descaling and multi-pass reversing mill rolling. A welder joins the strip, before entry to a descaler, from which the strip passes directly to the mill region. In the mill region, there are large strip accumulators whose intention is to allow the reversing mill to operate on the strip, portion by portion with multi-pass reverse rolling, while not interrupting the progress of the descaler. The strip is not sub-divided or coiled in the mill region. FIG. 3 of this document shows that the capacity becomes saturated, or nearly so, with a cycle length (i.e. the unit length of strip which is subjected to three-pass reversing rolling at one time) of 1,000 to 1,500 meters. Such a length is too short to obtain large benefits in the rolling operation. The apparatus also is impractical. Not only are the large accumulators expensive and bulky, but also it appears that their size limits the capacity of the machine. A large increase of accumulator capacity would result only in a small increase of productivity of the mill.

As mentioned above, JP-B-57-39844 proposes an improvement in the use of a reversing mill, but does not disclose a combined descaling and rolling line. Merely to provide a descaling line in front of the mill of JP-B-57-39844 would lead to an expensive plant, employing two welders and requiring space for storage of the coils, after descaling. The descaling apparatus, if placed after the welder shown in JP-B-57-39844, would be stopped when the welder stops, which is highly unsatisfactory for a descaler which should operate continuously to avoid over-pickling of parts of the strip. This stop time of the descaler would mean that the descaler has to be larger in nominal capacity than is required by the rolling mill capacity. Another disadvantage of the process of JP-B-57-39844 is the need to stop welding and winding a large coil on an entry drum during the first pass rolling, which reduces capacity. Yet another disadvantage is the need to stop the mill during its final pass at each time of coil division, which also reduces capacity.

SUMMARY OF THE INVENTION

The object of the present invention is to provide a solution to at least some of the problems identified above and to provide a descaling and cold rolling method for metal strip, which can be compact and have efficient and economical production capacity at a suitable scale. Another object is to provide apparatus for carrying out such a method.

The invention is based on the realization that, in a single apparatus line, the descaler and the reversing cold rolling mill can be operated simultaneously and at respective different strip entry speeds, by the interposition between them of means for forming large coils. This has the advantages, not appreciated in the prior art, that the descaler operating at a relatively low speed can be relatively short and therefore inexpensive, while the reversing mill is operated at appropriate speeds to give it a maximum production capacity. In this way, production capacities of both descaler and rolling mill can be maximized, without excessive investment cost, because each does not interfere in the operation of the other.

The production capacity of the relatively short descaler is matched to that of the reversing mill. Idle periods of the descaler and the mill in normal operation can be minimized or are eliminated. The descaler can operate continuously, with its output being divided to form the large coils, so avoiding over-pickling and other problems due to an idle period of the descaler, and avoiding the need for repeated threading of the descaler. Only one strip joining device such as a welder is required. The apparatus can operate almost as a fully continuous line, with interruption of continuity arising only on changing of the large coils fed into the reversing mill. The benefits of rolling long lengths in the reversing mill (i.e. reduction of number of reversals, reduction of threading time, improvement of yield due to reduction of strip end waste) are obtained.

In consequence, the welding, descaling, reversing rolling and re-division of the strip can be carried out highly efficiently with a compact and economic apparatus, having a production capacity making a maximum use of the reversing mill.

The long strip length which is coiled to form the large coils is typically several times the length of the conventional transportable coil. In one example, this long strip length is at least 5000 m, preferably more than 8000 m, e.g. 8000–12000 m.

In its first aspect, the invention provides a method of descaling and cold rolling metal strip, including joining strips longitudinally together, passing the joined strip continuously through a descaler, subdividing the descaled strip into long strip lengths and coiling the long strip lengths into large coils at a coiling station having a plurality of coiling drums, feeding the large coils from the coiling station to a reversing multi-pass cold rolling mill and rolling each of them in a plurality of passes with reversal in the mill. Coiling and uncoiling of two large coils take place simultaneously at the coiling station. Each long strip length is coiled a first time on one of the coiling drums at said coiling station on exit from the descaler and at least a second time on the same coiling drum during its rolling in the mill.

According to the invention in one aspect there is provided a method of descaling and cold rolling metal strip, comprising the steps of:

(a) joining a plurality of coils of the strip to form a long strip length, (b) passing the long strip length through a descaler, (c) winding the long strip length into a large coil, and (d) passing the long length strip in a plurality of passes, with reversing, through a reversible multi-pass cold rolling mill to effect cold rolling, with unwinding of the long strip length from said large coil and rewinding thereof between each two passes through the mill, (e) the steps (a) to (d) being performed in a single apparatus line and the speed of the strip in the descaler being different from the entry speed of the strip in each of the passes through the mill.

The long strip length typically does not correspond to a whole number of the coils from which it is formed. Thus, the strip exiting from the continuously operated descaler is divided into long strips of a length suitable for forming the large coils to be rolled.

Preferably, the long strip length is subdivided after the step (d), and coiled into a plurality of coils of descaled and cold-rolled strip.

In step (c) the long strip length is preferably coiled onto one of a first pair of coiling drums to form the large coil, and thereafter the first pair of coiling drums are mutually interchanged in position before unwinding of the large coil.

Likewise, after the final cold rolling pass, the long strip length is preferably recoiled onto a first one of a second pair of coiling drums, thereafter the second pair of coiling drums are mutually interchanged in position, and then said long strip length is unwound from the first one of the second pair of coiling drums.

In another aspect, the invention provides a method of descaling and cold rolling metal strip, comprising the steps of:

(a) sequentially joining a plurality of coils of the strip into a plurality of long strip lengths each comprising strips from a plurality of said coils, (b) sequentially subjecting each long strip length to the following sequence of steps:

(i) passing the long strip length through a descaler to effect descaling thereof, (ii) coiling the long strip length into a first large coil on exit from the descaler, (iii) uncoiling the first large coil, (iv) cold rolling the long strip length by passing the long strip length in a plurality of passes, with reversing, through a reversible multi-pass cold rolling mill, and recoiling the long strip length between each adjacent pair of passes, the first pass being performed with the uncoiling of the first large coil in step (iii), wherein said steps (a) and (b) are performed in a single apparatus line and wherein the descaler and the rolling mill operate simultaneously and the descaler has a pass speed of the strip which is different from the strip entry speed at the rolling mill of each of the passes.

Preferably, step (b)(ii) is performed simultaneously with the performing of step (b)(iii) on a previous long strip length in said sequence.

The step (b)(v) preferably includes the steps of coiling said long strip length after step (b)(iv) into a second large coil, uncoiling said second large coil, thereafter subdividing the long strip length into said portions and forming a plurality of coils therefrom.

In a further aspect, the invention provides a method of descaling and cold rolling metal strip, comprising the steps of:

(a) sequentially joining a plurality of coils of said strip into a plurality of long strip lengths each comprising strips from a plurality of said coils, (b) sequentially subjecting each of said long strip lengths to the following sequence of steps:

(i) passing the long strip length through a descaler to effect descaling thereof, coiling the long strip length into a first large coil on exit from said descaler, (iii) uncoiling the first large coil, (iv) cold rolling the long strip length by passing the long strip length in a plurality of passes, with reversing, through a reversible multi-pass cold rolling mill, and recoiling the long strip length between each adjacent pair of passes, the first pass being performed with the uncoiling of the first large coil in step (iii), (v) coiling the long strip length into a second large coil after the final pass through the rolling mill, (vi) uncoiling the second large coil, (vii) subdividing the long strip length into a plurality of portions as it is uncoiled in step (vi), (viii) coiling each of the plurality of portions of the long strip length, wherein steps (a) and (b) are performed in a single apparatus line and wherein steps (b)(ii) and (b)(iii) are performed simultaneously on two long strip lengths of the sequence by means of a first plurality of coiling drums which are cyclically employed for said steps b(ii) and b(iii), and said steps b(v) and b(vi) are performed simultaneously on two said long strip lengths of said sequence by means of a second plurality of coiling drums which are cyclically employed for said steps b(v) and b(vi), the first and second plurality of coiling drums also being used for said recoiling between each adjacent pair of passes through the cold rolling mill.

Preferably, the first plurality of coiling drums are mutually interchanged in position for the coiling step b(ii) and the uncoiling step b(iii) and the second plurality of coiling drums are mutually interchanged in position for the coiling step b(v) and the uncoiling step b(vi).

In its apparatus aspect, the invention provides apparatus for descaling and cold rolling of metal strip, comprising a line for processing of the strip which line comprises:

(a) a welder for joining a plurality of coils of the strip into a long strip length, (b) a descaler for continuous passage therethrough of the long strip length directly from the welder, (c) first coiling means for coiling a first large coil from the long strip length after passage through said descaler, (d) a reversible multi-pass cold rolling mill for reversibly rolling the long strip length from the first coiling means in a plurality of passes, and (e) second coiling means for winding a second large coil from the long strip length after rolling by the cold rolling mill, (f) the first and second coiling means effecting coiling and uncoiling of the long strip length during its reversible rolling in the cold rolling mill.

In this apparatus preferably, the line further includes:

(f) means for sub-dividing the long strip length when uncoiling it from the second coiling means after its rolling in the cold rolling mill, and (g) means for winding into individual coils the portions of the long strip length produced by the sub-dividing means.

Preferably, first coiling means comprises at least two coiling drums which are simultaneously and mutually alternatingly operable (i) to receive and coil one long strip length from the descaler and (ii) to coil and uncoil another long strip length undergoing rolling in the cold rolling mill.

The first coiling means may includes mean for mutually interchanging positions of the two coiling drums thereof.

Preferably, also the second coiling means comprises at least two coiling drums which are simultaneously and mutually alternatingly operable (i) to coil and uncoil a one long strip length undergoing rolling in the cold rolling mill and (ii) to uncoil another long strip length which has finished cold rolling. The second coiling means may include means for mutually interchanging positions of said two coiling drums thereof.

In this specification and claims, the terms "long strip length" and "large coil" are not intended to define particular sizes, but merely to indicate that the strip lengths rolled in the invention are substantially longer than the coils from which they are formed, and than the coils which are finally produced.

BRIEF INTRODUCTION OF THE DRAWINGS

Embodiments of the invention will be described below by way of non-limitative example with reference to the accompanying drawings, in which.

DESCRIPTION OF THE PREFERRED EMBODIMENTS

Figure 1:
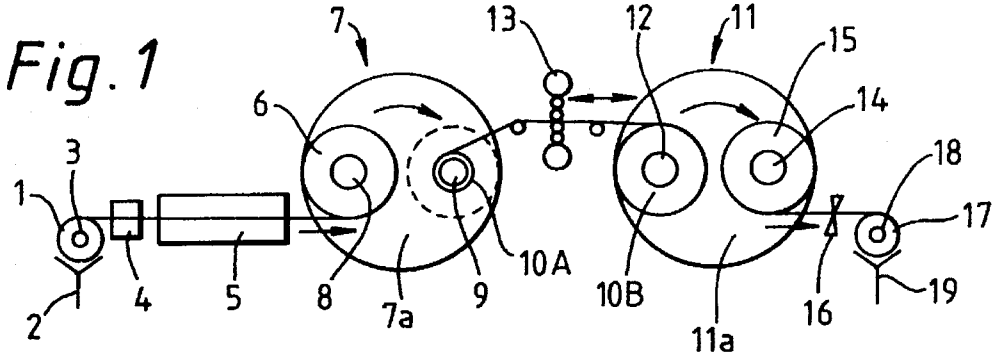
FIG. 1 is a schematic diagram showing the construction of the descaling and cold rolling apparatus according to one embodiment of the present invention.

In FIG. 1, the descaling and cold rolling apparatus embodying the present invention is a single line with a descaler 5 and a cold rolling mill 13 for reversible multi-pass cold rolling. At the entrance of the descaler 5, there is arranged a welder 4 for welding a plurality of hot-rolled coils 1 of regular transportable size to be fed to the descaler 5. Transport means 2 for the coils 1 is indicated. Between the descaler 5 and the reversible rolling mill 13, there is arranged an entrance side take-up and let-off device 7 for coiling the descaled strip to form a large coil 6 and simultaneously uncoiling the large coil 10A on the same line to feed it to the reversible rolling mill 13. At the exit of this reversible rolling mill 13, on the other hand, there is arranged a shearing machine 16 acting as re-dividing means for dividing again the cold-rolled large coil. 15. Between the reversible rolling mill 13 and the shearing machine 16, there is arranged an exit side take-up and let-off device 11 for coiling the cold-rolled strips to form a large coil 10B and simultaneously uncoiling a large coil 14 on the same line to feed it to the shearing machine 16. A hot-rolled coil let-off reel 3 is arranged at the entrance side of the welder 4, and a cold-rolled coil take-up reel 18 is arranged at the exit side of the shearing machine 16.

Not shown in FIG. 1 are an accumulator (looper) between the welder 4 and the descaler 5, and a shears after the descaler for dividing the strip exiting from the descaler 5 for coiling.

The entrance take-up and let-off device 7 and the exit take-up and let-off device 11 are each of the well-known carousel reel type, in which two expandable reel drums 8 and 9, and 12 and 14 are rotatably borne on rotary discs 7*a* and 11*a* so that they each can rotate on their individual axes, and can rotate as a pair about a central axis of the disc 7*a* or 11*a* to exchange their positions mutually.

An advantage of the Carousel devices 7, 11 illustrated here is that a high power driving motor is required only for the drums 9, 12 coiling or uncoiling the material being rolled by the mill. Relatively small motors are required for the drums 8, 14. The carousels 7,11 can therefore be arranged so that the drums 8, 9 and 12, 14 are interchanged in rotation of the discs 7*a*, 11*a*, but the respective motors are not interchanged. This reduces overall the cost of the motors required.

The regular size hot-rolled coils 1 are delivered by a hot-rolled coil car 2 from outside of the line onto the hot-rolled coil let-off reel 3 so that they are consecutively let off and welded by the welder 4. The coils delivered may vary in width and are cold. Then, a large coil 6 is taken up after the descaler 5 onto the drum 8 of the entrance take-up and let-off device 7. On the other hand, simultaneously using the other drum 9 of the entrance take-up and let-off device 7 and the drum 12 of the exit take-up and let-off device 11 a previous long strip length of forming coils 10A and 10B is rolled a predetermined number of passes (e.g. three or five) by the reversible rolling mill 13. Simultaneously, also the large coil 15 on the other drum 14 of the exit take-up and let-off device 11 is uncoiled and divided again by the shearing machine 16 so that it is taken up as a plurality of regular size cold-rolled coils 17 by the take-up reel 18. The coils 17 are delivered to outside of the line by the cold-rolled coil car 19.

Between the coiling and uncoiling of the large coils 6 and 10A between the descaler 5 and the reversible rolling mill 13, the disc 7*a* is rotated to interchange the positions of the drums 8 and 9. Likewise, the coiling and uncoiling of the large coils 10B and 15 between the reversible rolling mill 13 and the shearing machine 16 are likewise carried out with interchange of the positions of the drums 12 and 14.

There will now be described typical specifications of the large coils 6 and 10A, and 10B and 15. The hot coil handled by a conventional reversing mill has a weight of 10 to 20 tons, a length of about 500 to 1,000 m and a diameter of about 1.5 to 2 m. In the present embodiment of the invention in contrast, the large coils 6 etc. having a very large weight need not be transported, e.g. by the crane of the plant. Thus, no difficulty arises even if several regular size hot-rolled coils are connected to form a long strip length having a weight of 100 tons or more and a length of about 10,000 m. The length of the large coil may be 10 times as large as that of the regular hot-rolled coil, but the diameter of the large coil is about 5 m at most so that it can be handled with adequate ease.

In the present embodiment thus far described, the descaled strip is once taken up as the large coil 6 by the entrance take-up and let-off device 7, and the large coil 10A is let off and fed to the reversible rolling mill 13 so that the descaling step and the rolling step are carried highly efficiently independently in parallel without any interference. On the other hand, the strip thus rolled to a predetermined thickness is divided again to form the regular size coils 17. By the exit take-up and let-off device 11, moreover, the cold-rolled strip is taken up again, and the long coil 15 is let off and fed to the shearing machine 16. As a result, the rolling step and the redividing step are also carried highly efficiently independently without any interference.

At this time, the rolling step is usually carried out by the multi-pass reversible rolling and takes the longest time for one large coil. As a result, the descaling step and the re-dividing step have their internal line speed relatively reduced compared with the entry speed at each pass of the mill 13. Since, therefore, the descaler 5 is a chemical descaler, i.e., uses the pickling method,, the pickling tank can be short. If a mechanical descaler is used in combination with the chemical descaler, the descaler 5 can have its line length shortened and made compact.

Moreover, the various operations can be accomplished under selected conditions without interfering with each other. For example, the redividing and final coiling steps can be carried out at a low line speed for inspecting the surfaces of the rolled product. Thus, a treating step can be added, if required, to the re-dividing step.

As a result, the welding step, descaling step, reversible rolling step and re-dividing step of the coil can be carried out highly efficiently without any mutual interference. The strip entry speed of the descaler 5 is different from the higher strip entry speeds in the rolling passes in the mill 13. There is no waste between the descaling step and the cold-rolling step and between the cold-rolling step and the re-dividing step, while a suitable production scale is maintained. Only one expensive welder 4 is required so that a highly compact and economical apparatus can be realized.

Since the coil length rolled is long, the frequency of changing pass direction, which can cause trouble, can be drastically reduced to elongate the rolling time period of one cycle, so that the operation can be run stably with high productivity and production yield.

The rolling step is reversible using a large coil so that the productivity and production yield can become better than in reversible rolling methods of the prior art. The rolling mill need not be interrupted even at the welding time or the re-dividing time to improve the quality of the surface, yield and productivity of the product.

Figure 2:
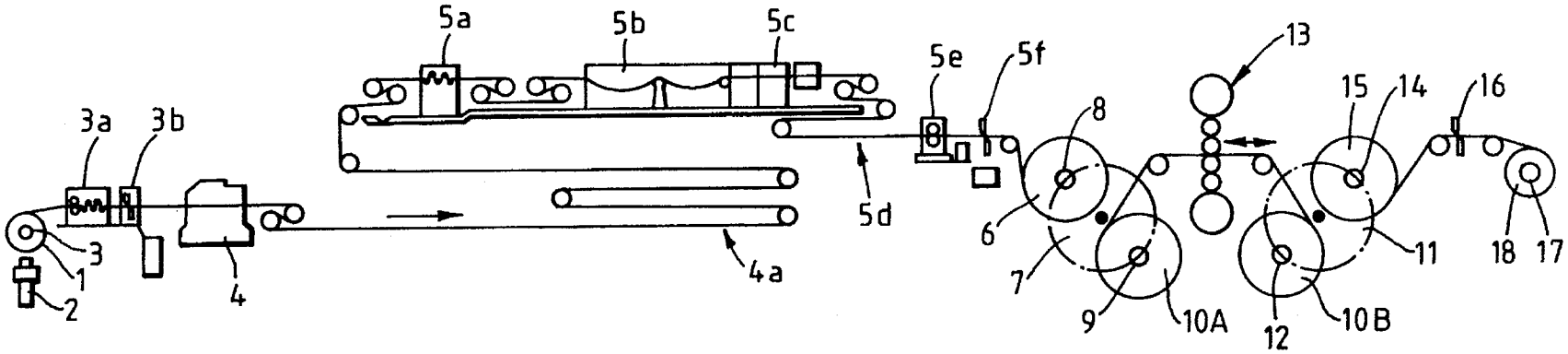
FIG. 2 is a schematic diagram of the construction of the descaling and cold rolling apparatus according to a second embodiment of the present invention.
Figure 3:
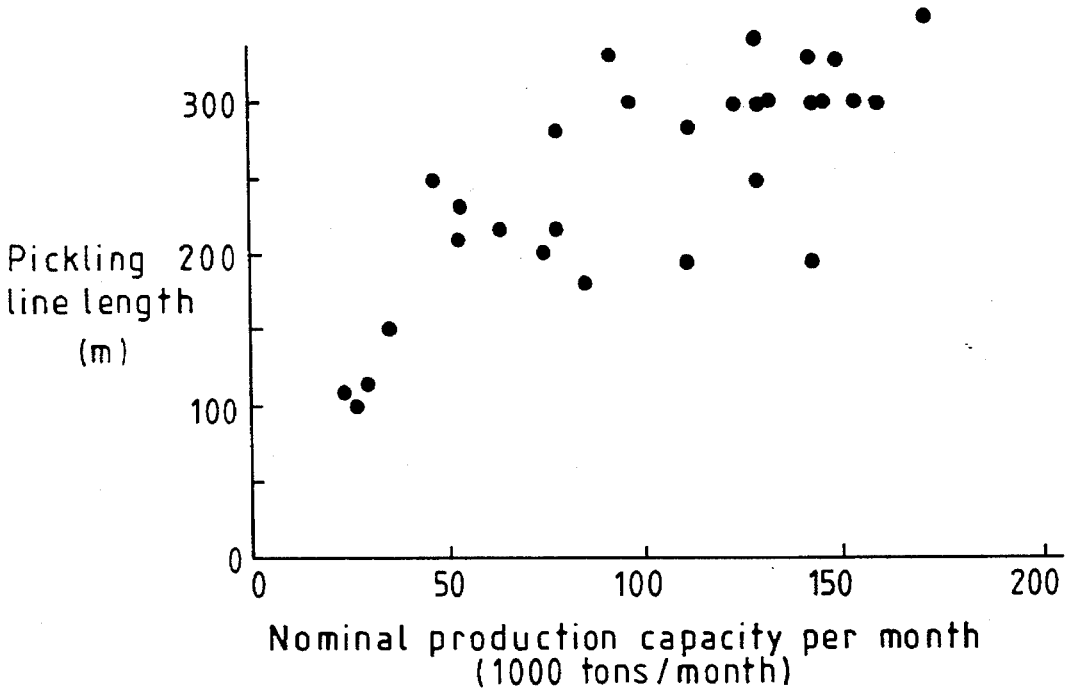
Fig. 3 PRIOR ART
FIG. 3 is a graph illustrating the relation between the nominal production capacity of pickling equipment existing in Japan and the equipment line length.
Figure 4:
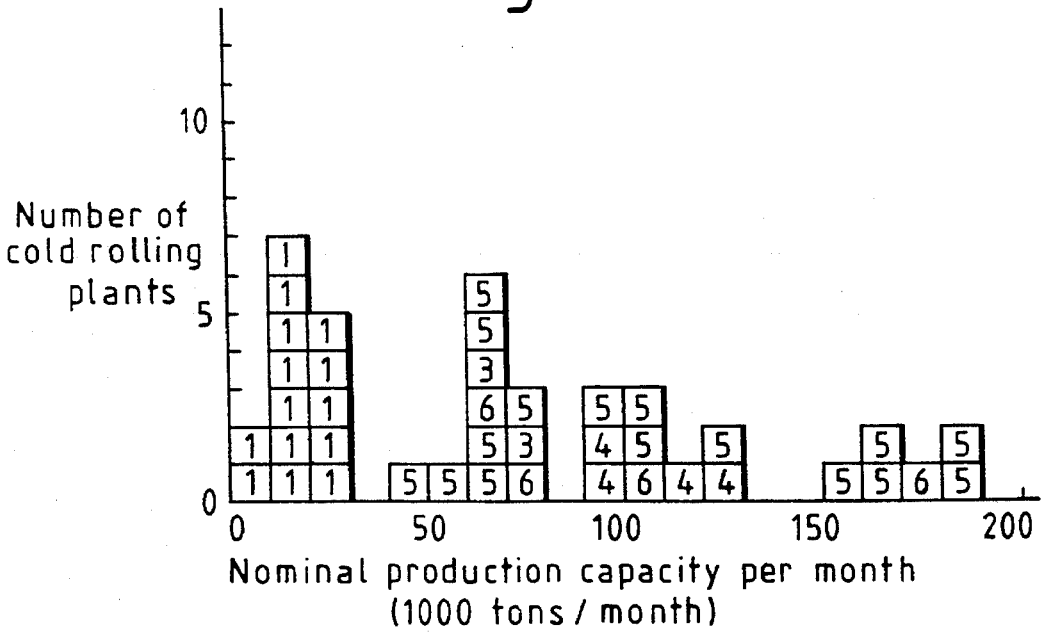
Fig. 4 PRIOR ART
FIG. 4 is a graph illustrating the number of cold rolling lines existing in Japan for respective nominal production capabilities, numerical values in bar graphs indicating the number of rolling mill stands in the individual lines.

FIG. 2 shows another embodiment of the apparatus of the invention, in which the parts corresponding to those of FIG. 1 are given the same reference numbers and will not be fully described again. From the reel 3, the uncoiling strip from the hot-rolled coil 1 passes through a straightener 3*a* and optional end shears 3*b* to the welder 4. After the welder 4 there is shown an accumulator (looper) 4*a* used to ensure that welding can take place without interruption of the descaler 5. The descaler 5 includes a scale breaker section 5*a*, an acid pickling tank 5*b* and a rinse tank 5*c*. A small accumulator 5*d* is located after the descaler 5, before an edge trimmer 5*e* (which prepares the descaled strip for coiling) and shears 5*f*, which divide the joined strip passing continuously through the descaler 5 into the successive long strip lengths for coiling as the large coils 6. The remainder of the line is substantially as shown in and described for FIG. 1.

This embodiment of FIG. 2 has a production capacity of about 60,000 tons/month (or 700,000 tons/year). The pickling line (from the reel 3 to the carousel device 7) occupies a space about 100 m in length.

It can be understood that the length of the long strip in each coil 6 does not correspond to an integral multiple of the length of the input coils 1. The length of the large coil 6 is chosen suitably for the cold rolling operation.

The descaling method and the descaler 5 are not limited to the chemical or mechanical types. These two types may be combined. It is also apparent that the type of the single stand reversing rolling mill is not especially limited. A six-high roll stand is indicated by way of example.

The take-up and let-off devices 7 and 11 may have carousel reel drums as solid drums which are not expandable nor contractible. In this case, the drum structures to be used need not be complex.

Furthermore, the present embodiment has been described with carousel reels in the take-up and let-off device 7 between the descaling step and the rolling step. However, the means for connecting those two steps as the same line can be exemplified devices such as a coil car, a coil conveyor or a coil hoist. The positional relation and distance between the two steps is not limited to those of the foregoing embodiments. Specifically, unlike the pickled coils of regular size of past practice in the art, the large coils formed at the descaling step are not extracted to be stored outside the line prior to rolling. A process falls within the scope of the concept of the present invention at least if the large coils are fed to the rolling step substantially in the order of preparation.

What is claimed is:

1. Apparatus for descaling and cold rolling of metal strip, comprising:

a welder for joining a plurality of coils of strip into a long length strip;

a descaler for continuous passage therethrough of said long length strip directly from said welder;

a reversible multi-pass cold rolling mill for reversibly rolling said long length strip after passage through said descaler; and an upstream coiling uncoiling device, disposed between said descaler and said reversible cold rolling mill and having at least two upstream coiling drums, said upstream coiling uncoiling device being simultaneously and mutually alternatingly operable to receive and coil said long length strip from said descaler by one of said upstream coiling drums and to uncoil and coil another said long length strip undergoing rolling in said reversible cold rolling mill by another of said upstream coiling drums.

2. Apparatus according to claim 1, wherein said upstream coiling device includes an upstream rotary disk carrying said at least two upstream coiling drums for rotation about separate respective upstream coiling drum axes.

3. Apparatus according to claim 2, wherein two of said upstream coiling drums are carried by said upstream rotary disk, said two upstream coiling drums being of substantially similar construction, and wherein two respective different size upstream driving motors are provided for rotatably driving the upstream coiling drums.

4. Apparatus according to claim 3, comprising means for rotating said upstream rotary disk to thereby mutually interchange positions of said two upstream coiling drums.

5. Apparatus according to claim 4, further comprising a downstream coiling uncoiling device, disposed downstream of said reversible cold rolling mill and having at least two downstream coiling drums, said downstream coiling uncoiling device being simultaneously and mutually alternatingly operable to coil a long length strip undergoing rolling in said reversible cold rolling mill by one of said downstream coiling drums and to uncoil another said long length strip by another of said at least two downstream coiling drums.

6. Apparatus according to claim 1, further comprising a downstream coiling uncoiling device, disposed downstream of said reversible cold rolling mill and having at least two downstream coiling drums, said downstream coiling uncoiling device being simultaneously and mutually alternatingly operable to coil a long length strip undergoing rolling in said reversible cold rolling mill by one of said downstream coiling drums and to uncoil another said long length strip by another of said at least two downstream coiling drums.

7. Apparatus according to claim 6, wherein said downstream coiling uncoiling device includes a downstream rotary disk carrying said at least two downstream coiling drums for rotation about separate respective downstream coiling drum axes.

8. Apparatus according to claim 7, wherein two of said downstream coiling drums are carried by said downstream rotary disk, and wherein two respective different size downstream driving motors are provided for rotatably driving the downstream coiling drums.

9. Apparatus according to claim 8, comprising means for rotating said downstream rotary disk to thereby mutually interchange positions of said two downstream coiling drums.

10. Apparatus according to claim 6, further including a shearing machine for sub-dividing said long length strip after rolling in said reversible cold rolling mill into a plurality of relatively short length strips; and a coiling device, each of said plurality of relatively short length strips wound onto said coiling device in turn.

11. Apparatus according to claim 6, wherein said apparatus is suitable for production of metal strip of about 50000 or more tons per month.

12. Apparatus for descaling and cold rolling of metal strip, comprising:

a welder for joining a plurality of coils of strip into a long length strip;

a descaler for continuous passage therethrough of said long length strip directly from said welder;

a reversible multi-pass cold rolling mill for reversibly rolling said long length strip after passage through said descaler; and a downstream coiling uncoiling device, disposed downstream of said reversible cold rolling mill and having at least two downstream coiling drums, said downstream coiling uncoiling device being simultaneously and mutually alternatingly operable to coil and uncoil a long length strip undergoing rolling in said reversible cold rolling mill by one of said downstream coiling drums and to uncoil another said long length strip by another of said at least two downstream coiling drums.

13. Apparatus according to claim 12, wherein said downstream coiling device includes a downstream rotary disk carrying said at least two downstream coiling drums for rotation about separate respective downstream coiling drum axes.

14. Apparatus according to claim 13, wherein two of said downstream coiling drums are carried by said downstream rotary disk, and wherein two respective different size downstream driving motors are provided for rotatably driving the downstream coiling drums.

15. Apparatus according to claim 14, comprising means for rotating said downstream rotary disk to thereby mutually interchange positions of said two downstream coiling drums.

16. Apparatus according to claim 15, further including a shearing machine for sub-dividing said long length strip after rolling in said reversible cold running mill into a plurality of relatively short length strips;

and a coiling device, each of said plurality of relatively short length strips wound onto said coiling device in turn.

17. Apparatus according to claim 12, further including a shearing machine for sub-dividing said long length strip after rolling in said reversible cold running mill into a plurality of relatively short length strips;

and a coiling device, each of said plurality of relatively short length strips wound onto said coiling device in turn.

18. A method of manufacturing metal strip, comprising:

joining a plurality of coils of strip into a long length strip by welding;

descaling said long length strip by continuously passing said long length strip directly from said welder through a descaler;

reversibly rolling the long length strip in a reversible multi-pass cold rolling mill after passage of said long length strip through said descaler; and coiling and uncoiling said strip in an upstream coiling uncoiling device, disposed between said descaler and said reversible cold rolling mill and having at least two upstream coiling drums, including simultaneously and mutually alternatingly operating the upstream coiling uncoiling device to receive and coil said long length strip from said descaler by one of said upstream coiling drums and to uncoil and coil another said long length strip undergoing rolling in said reversible cold rolling mill by another of said upstream coiling drums.

19. A method according to claim 18, wherein a pair of upstream coiling drums are provided, including coiling said long strip length onto one of said upstream coiling drums to form a large coil, thereafter mutually interchanging said pair of upstream coiling drums in position before unwinding of said large coil, and then uncoiling and coiling for reversible rolling said large coil at a changed position and with the same upstream coiling drum as used for producing said large coil from said long strip length.

20. A method according to claim 18, wherein said descaling is carried out at a different speed of strip movement than an entry speed of the strip in each pass through the reversible rolling mill.

21. A method according to claim 20, wherein a pair of upstream coiling drums are provided, including coiling said long strip length onto one of said upstream coiling drums to form a large coil, thereafter mutually interchanging said pair of upstream coiling drums in position before unwinding of said large coil, and then uncoiling and coiling for reversible rolling said large coil at a changed position and with the same upstream coiling drum as used for producing said large coil from said long strip length.

22. A method according to claim 20, wherein said upstream coiling drums are of substantially similar construction, and wherein respective different size driving motors are used for driving said upstream coiling drums, when they are operating to receive the strip from the descaler and when they are operating to coil and uncoil said strip during rolling.

23. A method according to claim 20, further comprising coiling and uncoiling said strip in a downstream coiling uncoiling device, disposed downstream of said reversible cold rolling mill and having at least two downstream coiling drums, including simultaneously and mutually alternatingly operating the downstream coiling drums to coil and uncoil a long length strip undergoing rolling in said reversible cold rolling mill by one of said downstream coiling drums and to uncoil another said long length strip by another of said downstream coiling drums.

24. A method according to claim 18, further comprising coiling and uncoiling said strip in a downstream coiling uncoiling device, disposed downstream of said reversible cold rolling mill and having at least two downstream coiling drums, including simultaneously and mutually alternatingly operating the downstream coiling drums to coil and uncoil a long length strip undergoing rolling in said reversible cold rolling mill by one of said downstream coiling drums and to uncoil another said long length strip by another of said downstream coiling drums.

25. A method according to claim 24, wherein said downstream coiling drums are of substantially similar construction, and wherein separate driving motors are used for driving said downstream coiling drums when coiling and uncoiling during rolling and when uncoiling after completion of rolling.

26. A method according to claim 25, including subdividing said long length strip downstream of the downstream coiling uncoiling device and subsequent coiling of said subdivided strip into a plurality of coils of descaled and cold-rolled strip.

27. A method of manufacturing metal strip, comprising:

joining a plurality of coils of strip into a long length strip by welding;

descaling said long length strip by continuously passing said long length strip directly from said welder through a descaler;

reversibly rolling the long length strip in a reversible multi-pass cold rolling mill after passage of said long length strip through said descaler; and coiling and uncoiling said strip in a downstream coiling uncoiling device, disposed downstream of said reversible cold rolling mill and having at least two downstream coiling drums, including simultaneously and mutually alternatingly operating the downstream coiling drums to coil and uncoil a long length strip undergoing rolling in said reversible cold rolling mill by one of said downstream coiling drums and to uncoil another said long length strip by another of said downstream coiling drums.

28. A method according to claim 27, wherein said downstream coiling drums are of substantially similar construction, and wherein separate driving motors are used for driving said downstream coiling drums when coiling and uncoiling during rolling and when uncoiling after completion of rolling.

29. A method according to claim 28, wherein said upstream coiling drums are of substantially similar construction, and wherein respective different size driving motors are used for driving said upstream coiling drums, when they are operating to receive the strip from the descaler and when they are operating to coil and uncoil said strip during rolling.

* * * * *